US007318414B2

(12) United States Patent
Hou

(10) Patent No.: US 7,318,414 B2
(45) Date of Patent: Jan. 15, 2008

(54) CONSTANT-SPEED MULTI-PRESSURE FUEL INJECTION SYSTEM FOR IMPROVED DYNAMIC RANGE IN INTERNAL COMBUSTION ENGINE

(75) Inventor: Shou L. Hou, Wayne, PA (US)

(73) Assignee: TMC Company, Wayne, PA (US)

( * ) Notice: Subject to any disclaimer, the term of this patent is extended or adjusted under 35 U.S.C. 154(b) by 440 days.

(21) Appl. No.: 10/143,657

(22) Filed: May 10, 2002

(65) Prior Publication Data

US 2003/0209232 A1 Nov. 13, 2003

(51) Int. Cl.
*F02M 59/36* (2006.01)
*F02M 37/00* (2006.01)

(52) U.S. Cl. ..... 123/458; 123/510; 123/511; 123/514

(58) Field of Classification Search ..... 123/457, 123/458, 506, 446, 447, 497, 510–511, 514
See application file for complete search history.

(56) References Cited

U.S. PATENT DOCUMENTS 3,827,409 A * 8/1974 O'Neill ..... 123/458
4,274,380 A * 6/1981 de Vulpillieres ..... 123/456
4,353,385 A 10/1982 Maisch et al.
4,719,889 A * 1/1988 Amann et al. ..... 123/447
5,035,223 A * 7/1991 Watanabe ..... 123/459
5,085,193 A * 2/1992 Morikawa ..... 123/458
5,207,203 A * 5/1993 Wagner et al. ..... 123/514
5,284,119 A * 2/1994 Smitley ..... 123/497
5,313,924 A * 5/1994 Regueiro ..... 123/456
5,327,872 A * 7/1994 Morikawa ..... 123/516
5,351,666 A * 10/1994 Bronkal et al. ..... 123/359
5,355,859 A 10/1994 Weber
5,367,999 A 11/1994 King et al.
5,373,829 A * 12/1994 Schuers et al. ..... 123/510
5,425,342 A * 6/1995 Ariga et al. ..... 123/456
5,456,233 A * 10/1995 Felhofer ..... 123/447
5,513,613 A 5/1996 Taylor et al.
5,558,063 A 9/1996 Minagawa et al.
5,572,964 A * 11/1996 Cogneville et al. .... 123/179.17
5,598,817 A * 2/1997 Igarashi et al. ..... 123/179.17
5,642,716 A * 7/1997 Ricco ..... 123/456
5,720,263 A * 2/1998 Frank et al. ..... 123/514
5,727,515 A * 3/1998 Biester ..... 123/198 D
5,727,525 A * 3/1998 Tsuzuki ..... 123/447
5,758,622 A * 6/1998 Rembold et al. ..... 123/456
5,762,046 A 6/1998 Holmes et al.
5,784,586 A 7/1998 Simone et al.
5,794,586 A * 8/1998 Oda et al. ..... 123/305

(Continued)

*Primary Examiner*—Thomas N. Moutis
(74) *Attorney, Agent, or Firm*—Stephen H. Eland; Dann, Dorfman Herrell & Skillman

(57) ABSTRACT

A fuel injection system operates under a substantially constant pump speed and creates multi-pressure levels by diverting the fuel flow. Fuel pressure can be switched from one steady pressure level to another level on-demand instantly. This superimposes and overlaps typical fuel injection events in the linear operating ranges under different pressure levels, significantly increasing the fuel injection dynamic range. Lower fuel injection when idle or during city driving reduces fuel consumption per mile traveled and reduces exhaust emission that causes smog in metropolitan areas. The system delivers additional power to the engine instantly at peak load on-demand, reduces idle speed with the engine running smoothly, does not change fuel tank temperature, and may enhance the life of the fuel pump.

46 Claims, 6 Drawing Sheets

U.S. PATENT DOCUMENTS 5,918,578 A * 7/1999 Oda ..... 123/456
5,927,253 A * 7/1999 Oyafuso et al. ..... 123/456
5,967,119 A * 10/1999 Burkhard et al. ..... 123/458
6,021,763 A * 2/2000 Yoshihara et al. ..... 123/516
6,024,064 A * 2/2000 Kato et al. ..... 123/179.17
6,032,642 A 3/2000 Trumbower et al.
6,119,655 A * 9/2000 Heinitz et al. ..... 123/447
6,125,823 A 10/2000 Thomas
6,142,120 A * 11/2000 Biester et al. ..... 123/456
6,155,234 A * 12/2000 Hartke et al. ..... 123/459
6,170,473 B1 * 1/2001 Pontoppidan ..... 123/514
6,223,725 B1 * 5/2001 Onishi et al. ..... 123/447
6,234,151 B1 * 5/2001 Eck ..... 123/514
6,253,735 B1 * 7/2001 Miyajima ..... 123/456
6,276,340 B1 * 8/2001 Kato ..... 123/491
6,394,072 B1 * 5/2002 Yoshida et al. ..... 123/506
6,408,822 B1 * 6/2002 Rembold et al. ..... 123/447
6,712,044 B1 * 3/2004 Rembold et al. ..... 123/456
2001/0018908 A1 * 9/2001 Joos et al. ..... 123/497
2003/0183199 A1 * 10/2003 Vahle et al. ..... 123/458
2005/0034710 A1 * 2/2005 Crary et al. ..... 123/457

* cited by examiner

Data From An Injector Manufacturer

CONSTANT-SPEED MULTI-PRESSURE FUEL INJECTION SYSTEM FOR IMPROVED DYNAMIC RANGE IN INTERNAL COMBUSTION ENGINE

FIELD OF THE INVENTION

This invention relates to engines, specifically a fuel system used for engines making use of a fuel injection system.

BACKGROUND OF THE INVENTION

Engine emission, such as auto emission, is one of the most contributing factors to air pollution. It is most noticeable in metropolitan areas during traffic jams, and around airports where numerous airplanes are idling in the secondary runway for 20 to 40 minutes on the average before taking off. Reducing the idle speed in internal combustion engines will save fuel when an engine is not doing much work other than keeping it alive. It also reduces exhaust emission, which converts to smog. The problem is most serious in metropolitan areas because there are close to 100-million cars and trucks in the U.S., most of which are concentrated in the metropolitan areas. Perhaps a more meaningful way of reducing pollution and improving energy is by measuring how much fuel is consumed per mile traveled by any vehicle at any speed. This measurement indicates the amount of fuel consumed and exhaust generated in the distance traveled. It becomes apparent that a better control of fuel consumption at slow speed (or idle) will have more impact on pollution control, fuel saving, and improvement on the city driving mileage.

Improving control of fuel consumption at low speeds must not adversely affect performance of the engine. For example, it is commonly known in physics that the kinetic energy of a moving vehicle is directly proportional to its mass (or weight). More energy is required to maintain a heavier vehicle at any speed than a lighter vehicle at the same speed. On the other hand, the amount of energy delivered by a gallon of gasoline is constant. As a result, more fuel is needed to move a heavier vehicle than a lighter one in highway driving. More fuel is also needed to accelerate a vehicle quickly. In view of these considerations, it is desirable to meet the energy demands of the engine over the full range of load conditions while also lowering fuel consumption, especially during idle.

Engine pistons deliver torque T to the flywheel. This is balanced by frictions of the engine and the drag by accessories like the cooling flywheel fan and generator when idle. To the first order of approximation, the balancing torque is proportional to the speed of rotation R. The power required to keep the flywheel idling at a speed of rotation R is TR. It is supplied by fuel injected per second Q. The kinetic energy of the flying wheel is transmitted to the moving vehicle through mechanical means.

Since Energy delivered to the engine per second~Q~Tω Power produced by the engine and $$Q \sim \omega q$$

$$\text{hence, } q \sim T \sim I\alpha \sim M\omega \quad (1)$$

$$\text{and } Q \sim q^2 \quad (2)$$

where ωis the engine speed in rps (or in rpm/60),

M is the effective mass of the engine flying wheel,

T is the torque, "α" is the angular acceleration,

I is the angular moment of inertia of the flying wheel,

Q is the total amount of fuel injected per second, and q is the amount of fuel injected per pulse.

In other words, to the first order of approximation, the engine idling speed ω is directly proportional to the amount of fuel injected per pulse q, and the total amount of fuel consumption rate Q is proportional to the square of the amount of fuel injected per pulse q. A 10% reduction to the fuel injected per pulse will save about 19% of total fuel consumption per second when idle.

Fuel injectors are commonly used in today's automotive vehicles to replace earlier fuel feeding through carburetors. A fuel system generally has a fuel pump which may be either submerged in the fuel tank or positioned outside the tank, and which pumps fuel under pressure through the fuel line, to the fuel rail, into the fuel injectors. A fuel injector with a proper nozzle design sprays fuel mist at the air in-take manifold of a cylinder in an engine block. Fuel mist combined with air in proper ratio is drawn into an engine cylinder during the in-take stroke. An optimum air/fuel mix has a stoichiometric ratio of 14.7 to 1 that makes detonation easier and combustion more complete. Fuel injectors are located near (or inside) the engine cylinder at an elevated temperature. A spring loaded electro-mechanically controlled ball valve is used to seal off the nozzle of the fuel injector. This prevents pressurized fuel from seeping into the engine block when it is not running. Pressurized fuel reduces fuel vapor in the fuel line, which minimizes vapor lock; vapor lock may interfere with hot engine start-up. When an operator pushes the gas pedal, the pushing of the pedal is converted into an electric signal sent to a microprocessor. Together with the engine operating information from various sensors, the microprocessor then activates the fuel injector to deliver a pre-determined quantity of fuel to the engine cylinder through the fuel injection process.

The amount of fuel injected per pulse q is linearly proportional to the pulse width of the electrical pulse sent.

$$q = k(t - C) \quad (3)$$

$$\text{and } k \sim P^n \quad (4)$$

where q is the amount of fuel injected per pulse, k is a constant that reflects the continuous injection rate per second, t is the pulse width of fuel injection pulse, C is a correction constant, and n is a constant.

The continuous injection rate k is a strong function of fuel pressure P. The quality of sprayed mist also depends upon the design of the shape of the nozzle. To the first order of approximation, "n" is about ½. The actual value varies between ½ and ⅓ with the latter value toward higher pressure. In other words, to double the fuel injection rate under identical operating conditions, the fuel pressure must be increased by at least 4-fold. The linearity and reproducibility must be maintained to within 1% in the linear operating range to avoid irregular engine behavior when vehicles are mass-produced. The microprocessor receives information from various sensors in the engine and determines the pulse width based upon the amount of fuel needed.

In sequential multi-port injection, a fuel injector is mounted to the fuel in-take port to a given engine cylinder (or directly into the cylinder).

At full power, where maximum fuel injection is used, an exemplary engine is running at about 6,000 rpm. Fuel in-take strokes generally last only about 5 milliseconds. In the mean time, just "opening" and "closing" a spring-loaded ball valve physically takes more than one millisecond. This sets the minimum pulse width for fuel injection during idling to no less than 2 milliseconds. The fuel injection pulse width is thus limited by the time needed for operating a spring loaded ball valve and, as a result, may have an unpredictable amount of fuel injection and cause erratic engine performance. The typical linear range to operate a fuel injector is between 2 to 10 milliseconds, for a variety of different internal combustion engines. A manufacturer generally must choose the diameter of the nozzle at a given fuel pressure to achieve maximum power at a maximum pulse width. This limits the so-called dynamic range of the fuel injection system, as the system parameters need to be chosen to achieve the desired power with the available pulse width. As a result, fuel injection systems often have too much fuel injected at the lower end of the range, that is, where there is a minimum pulse width, when idling. Thus, the dynamic range of fuel injection has room for improvement.

For example, U.S. Pat. No. 5,355,859 to R. E. Weber changes the voltage applied to a fuel pump to generate and maintain variable fuel pressure. U.S. Pat. No. 5,762,046 to J. W. Holmes et al. uses a resistor in series with the fuel pump coil. By selectively bypassing the series resistor per control signal from the microprocessor, a fuel pump will have different applied voltages to create dual speed for the fuel delivery system. However, because a fuel pump generally has a large inductive load, varying the voltage applied to the fuel pump generally does not stabilize fuel pressure for a period of seconds. This delay in fuel pump stabilization in turn causes a delay in engine response and needs fine adjustment to compensate the voltage drop across the resistor in order to maintain smooth operation. Furthermore, since only a minute quantity of fuel is needed to keep an engine alive when idle, to assure the injection is operating within appropriate linear range, the fuel pump generally must run at very low speeds. To achieve such very low speeds in the fuel pump, the voltage applied to the pump generally must also be correspondingly low. When operated on such correspondingly low voltages, the fuel pump may run sluggishly, resulting in undesirable pressure fluctuations. Also, the pump may have a shorter life and decreased reliability if it runs at variable speeds with the associated frequent and sudden acceleration/decelerations of such variances.

The response time required to change the speed of the fuel pump is unacceptably slow in comparison to the fuel injection process. Since fuel metering depends on how much fuel is being delivered by the fuel pump, undesirable pressure fluctuation generally occurs at the time when fuel injection pulses are taking place. The attempts of the art to address the above-outlined drawbacks have had mixed results at best. Excess fuel supply, a pressure regulator, and a pressure gauge are often used to minimize the pressure fluctuation during fuel injecting. A pressure release valve and an excess-fuel-return line from the fuel rail are also installed to bleed the excess fuel accumulated in the fuel rail back to the fuel tank. The hot fuel returned to the fuel tank raises the temperature in the fuel tank during prolonged operation. Precautions are also needed to recover the hot fuel vapor in the fuel system.

SUMMARY OF THE INVENTION

A constant speed multi-pressure fuel injection system has been developed. The fuel system has a pump running at a constant drive (or at a constant speed) while at the same time multiple pressure levels are created through different means. It provides the capability to instantly increase fuel supply to an engine on-demand instead of waiting for the system to stabilize before being capable of delivering more fuel. The same system is also capable of delivering much less fuel to keep the engine running when idle to save fuel.

This invention describes the structure and process of fuel injection delivery systems which create multi-pressure-levels on-demand instantly by restricting the fuel flow at a given steady fuel pump speed. This increases the dynamic range of fuel injection and minimizes fuel pressure fluctuation. Hence, the same engine that incorporates the invention is capable of doing the following: (1) Delivering more power instantly at peak load on-demand, which accelerates the vehicle from stand still to 60 miles per hour in seconds; (2) Reducing the idle speed with the engine still running smoothly, which saves fuel, improves city-driving mileage, and further reduces exhaust when idle; (3) Not changing the fuel tank temperature regardless of how long the engine is in operation; and (4) Enhancing the life of the fuel pump because the pump is running at a constant speed without frequent acceleration/deceleration. Although fuel saving and exhaust control may not seem much to a single vehicle, the cumulative effect should be noticeable in a traffic jam, or anywhere large number of vehicles are crawling with engines running. The invention can be applied to internal combustion engines used in automobiles, airplanes, and diesel engines. Thus, it saves fuel to achieve better city-driving mileage. Most of the existing vehicles already in operation for years can also be modified with minimum effort to achieve a reduced idle speed and still be able to run smoothly. When the invention is applied to a large number of vehicles, the public can enjoy the cumulative effect of cleaner air in metropolitan areas.

By adjusting constrictions of fuel flow, the fuel injection system has a wider dynamic range (defined as the ratio of the maximum amount versus minimum amount of fuel injected per second) so that it can provide instantly very low yet steady fuel pressure to deliver a minute quantity of fuel to be injected per pulse to keep the engine running smoothly even at very low speed (or idle). The same fuel injection system can also provide additional fuel pressure on-demand instantly to deliver more power when the operator has to quickly accelerate. All of these functions are accomplished while the fuel pump is running steadily at a constant speed.

In addition, a fuel-return line diverts a small portion of fuel from the output of the pump (or from the main filter) to the fuel tank to stabilize the fuel system at the predetermined pressure. In other words, the fuel-return line system minimizes fuel pressure fluctuation caused by pump metering action. It also takes away the need to bleed the excess hot fuel at the fuel rail and return it to the fuel tank to avoid pressure built-up at the fuel rail. Without hot fuel returning to the tank, the temperature in the fuel tank will remain unchanged regardless of how long the vehicle is in operation.

Depending upon the operator's desire and sensor signals from the engine, such as, but not limited to, airflow, engine speed, torque, and temperature, the fuel system can be switched from one steady state to another state at a new pressure level almost instantly without changing the drive (or speed) of the fuel pump. The stabilization of fuel pressure allows a microprocessor to predict a proper fuel injection pulse width for delivering the desired amount of fuel per pulse. It also minimizes the guessing processes to deliver a proposed fuel quantity per pulse in the split injection process commonly used in a diesel engine.

An important objective of this invention is the capability to change the fuel pressure from one steady state to another state instantly and precisely, while the pump is running at a constant speed. The pressure at each state is steady with minimum pressure fluctuation. It assures a more accurate estimate of the amount of fuel to be delivered to the engine.

Another objective of this invention is to be able to change from a normal operating fuel pressure to a very low and steady pressure instantly with minimum ripple for idle and for low speed driving while the pump is running at a constant speed at a comfortable voltage.

A further objective of this invention is to instantly switch from normal operating pressure to a higher fuel pressure on-demand for quick acceleration without changing the driving voltage applied to the fuel pump.

Yet a further objective of this invention is to constantly circulate fuel through the fuel-return line to maintain a constant fuel pressure and to avoid excess fuel and pressure built-up at the fuel-rail. Thus, hot fuel from the fuel rail does not need to return to the fuel tank and the temperature in the tank will remain unchanged regardless of how long the vehicle is in operation. Constant fuel pressure also assures a more predictable amount of fuel injected per pulse.

All of these objectives can be achieved while the fuel pump is running at a constant speed (or the drive voltage applied to the fuel pump is set at a constant value well within a comfortable linear operating range of the fuel injector). Because the fuel pump is not subjected to frequent and sudden acceleration/deceleration, the life of the pump may be prolonged.

In the drawings, which are discussed below, one or more preferred embodiments are illustrated, with the same reference numerals referring to the same pieces of the invention throughout the drawings. It is understood that the invention is not limited to the preferred embodiment depicted in the drawings herein, but rather it is defined by the claims appended hereto and equivalent structures.

DETAILED DESCRIPTION OF THE PREFERRED EMBODIMENTS

While the specification concludes with claims particularly pointing out and distinctly claiming the subject matter which is regarded as the invention, the invention will now be further described by reference to the following detailed description of preferred embodiments taken in conjunction with the above-described accompanying drawings.

Figure 1:
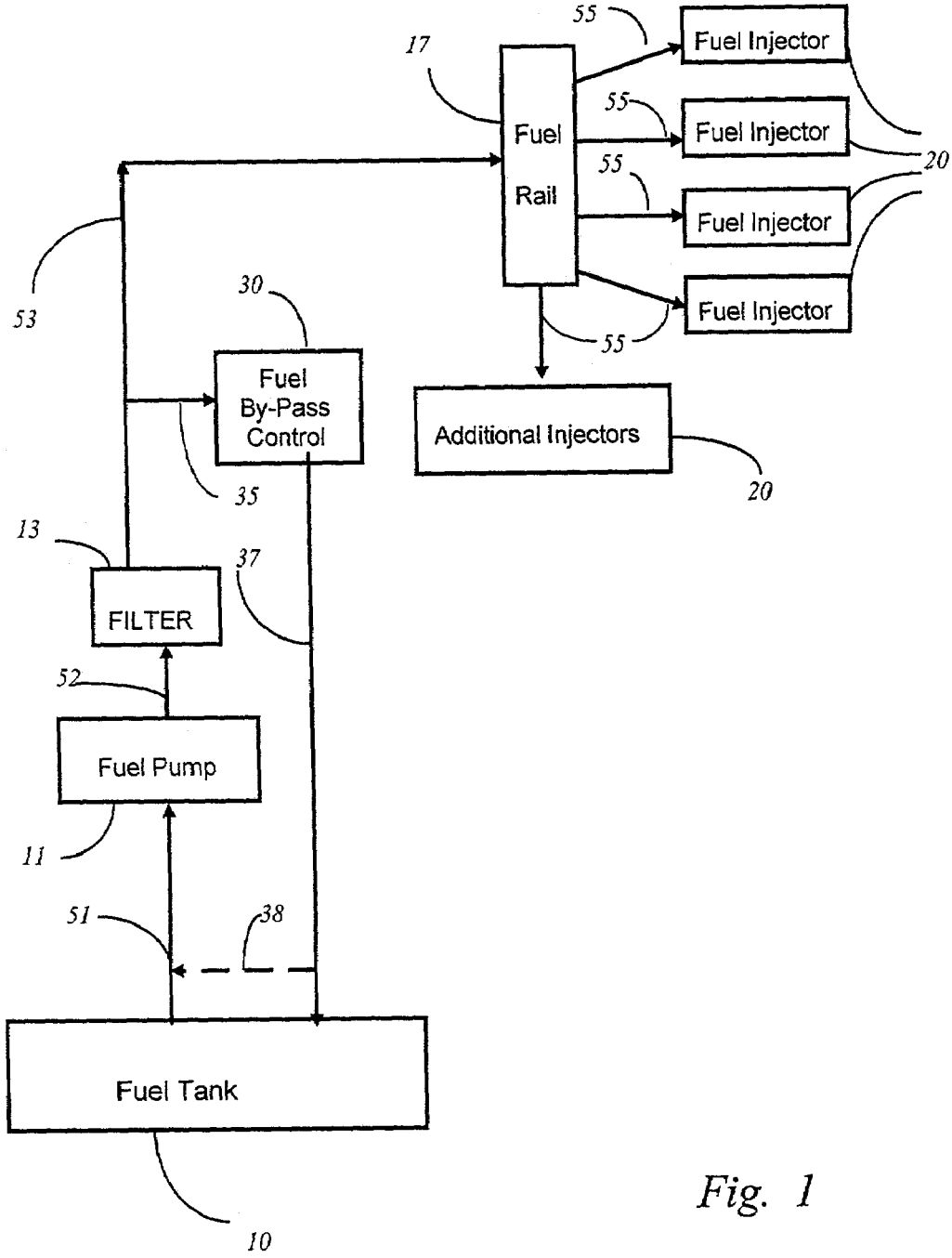
FIG. 1 is a schematic drawing of a dual pressure fuel injection delivery system according to the present invention.
Figure 2:
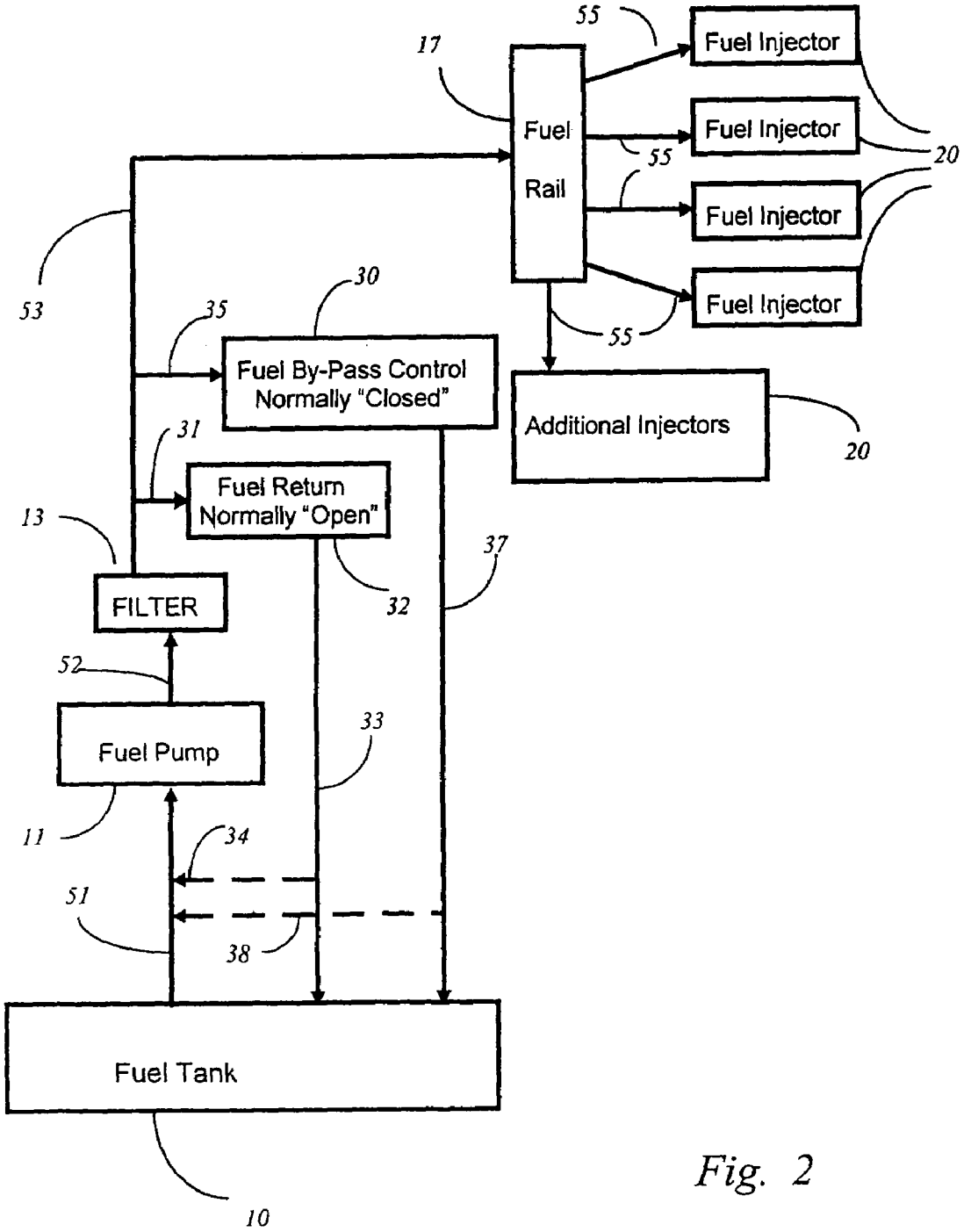
FIG. 2 is a schematic diagram of a multi-pressure fuel injection delivery system that uses a Fuel-Return Line to stabilize fuel pressure according to the present invention.
Figure 5:
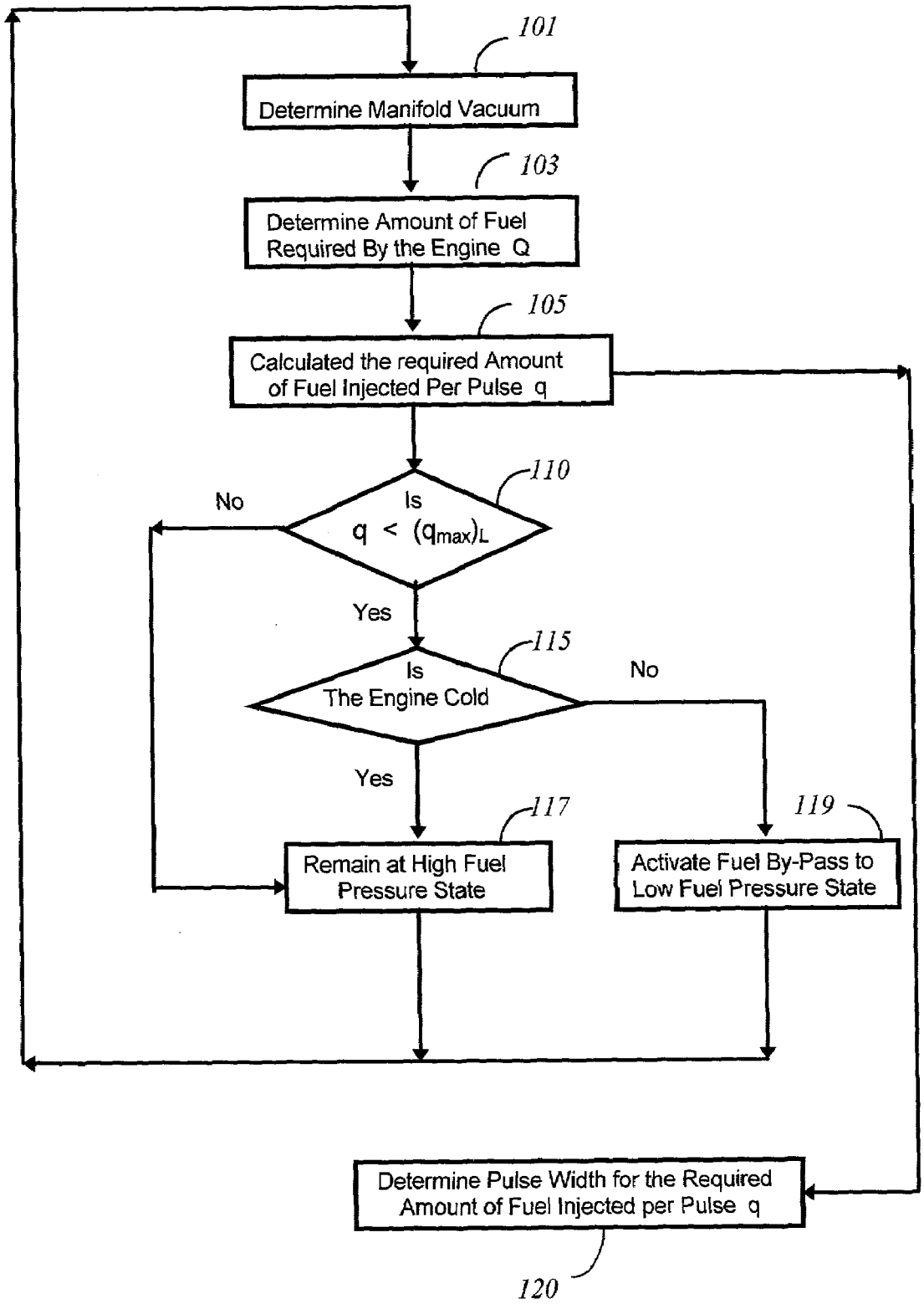
FIG. 5 is a flow chart of a microprocessor electronic signal execution sequence that shows the operation of a dual pressure single speed fuel injection delivery system according to the present invention.
Figure 6:
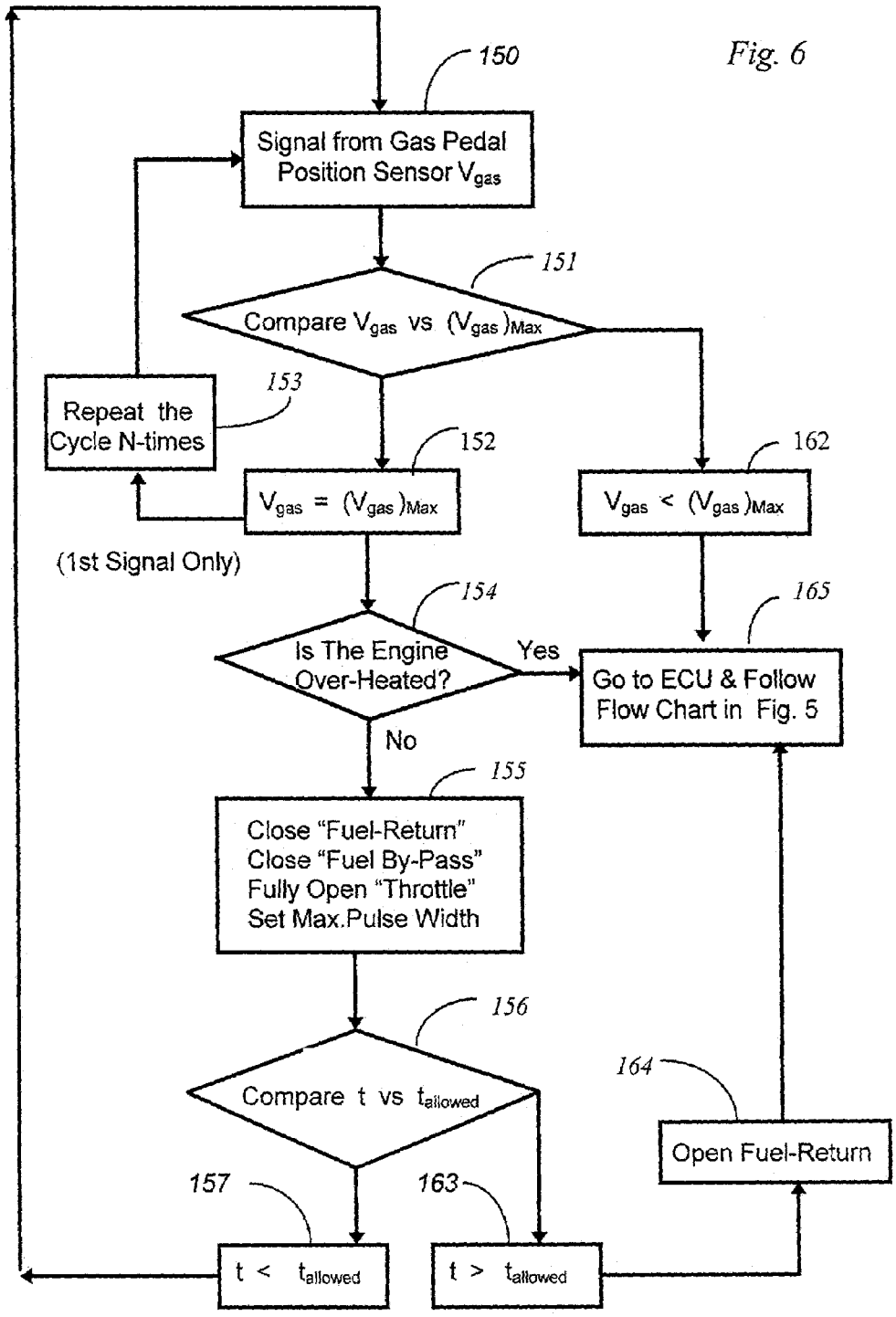
FIG. 6 is a flow chart that shows the operations of the invention when an operator desires instant maximum power on-demand.

The structures of fuel injection systems of the current invention are shown in FIG. 1 and FIG. 2. The illustration of its operations and its properties will refer to both figures. Not shown in those figures yet well understood to technical professionals in microelectronics is the set-up of microelectronics used to control the system. An embedded controller, a microprocessor, or a programmable logic circuit can be used as the brain. It may be a standalone unit, or a subroutine of the main CPU (or ECU) of the vehicle. The program may be embedded in ROM, PROM, EPROM, or other conventional storage media like hard disk, CD-ROM, tape drive, etc. The program is executed by the microprocessor through the RAM. The sequence and logic of the control are shown in FIG. 5 and FIG. 6.

A. Basic Fluid System that Creates Dual-Pressure Instantly

FIG. 1 is one embodiment of the invention. The inventive fuel injection fluid system comprises the following parts: fuel tank 10; fuel pump 11 (which may be submerged in the fuel tank, or installed outside the tank); main fuel filter 13; fuel supply lines 51, 52, 53, 55 which connect the various components of the system in fluid communication; fuel rail 17 to which all of the fuel injectors 20 are connected; fuel by-pass control 30; and fuel by-pass lines 35, 37 which feed the extra by-pass fuel from the main fuel line 53 to fuel tank 10 or through line 38 to the fuel in-take line 51 to the fuel pump 11 for re-using in the fuel injection process. Fuel pump 11 runs at a constant speed well within the comfortable operating range of a pump.

Fuel by-pass control 30 preferably has an electromechanically controlled valve (normally closed or open depending upon its operation). Lines 35, 37 and by-pass control 30 comprise a by-pass for fuel to be partially diverted from the main fuel line 53. When fuel by-pass control 30 is normally closed, fuel pump 11 supplies fuel to the fuel injectors only. When by-pass control 30 is open, fuel pump 11 will deliver additional fuel to be by-passed through fuel lines 35, 37 back to fuel tank 10 (or pass through line 38 to fuel in-take line 51 to fuel pump 11.)

Proper restrictions are imposed on the by-pass fuel flow outlined above. For example, one may choose the size of the fuel by-pass lines 35, 37, 38 so that they provide proper flow resistance or introduce a restriction by other means. For those familiar with fluid control, the means include, but are not limited to, using a needle valve or a diaphragm-like plate with a hole that has a proper diameter for fuel restriction. Regardless of what the state of fuel by-pass control 30 is in (open or closed), fuel pump 11 runs continuously under a constant voltage drive (or at a constant speed). The changes in the fuel flow rate through the fuel pump under a constant drive create different steady fuel pressure states for the fuel supply system.

Figure 3:
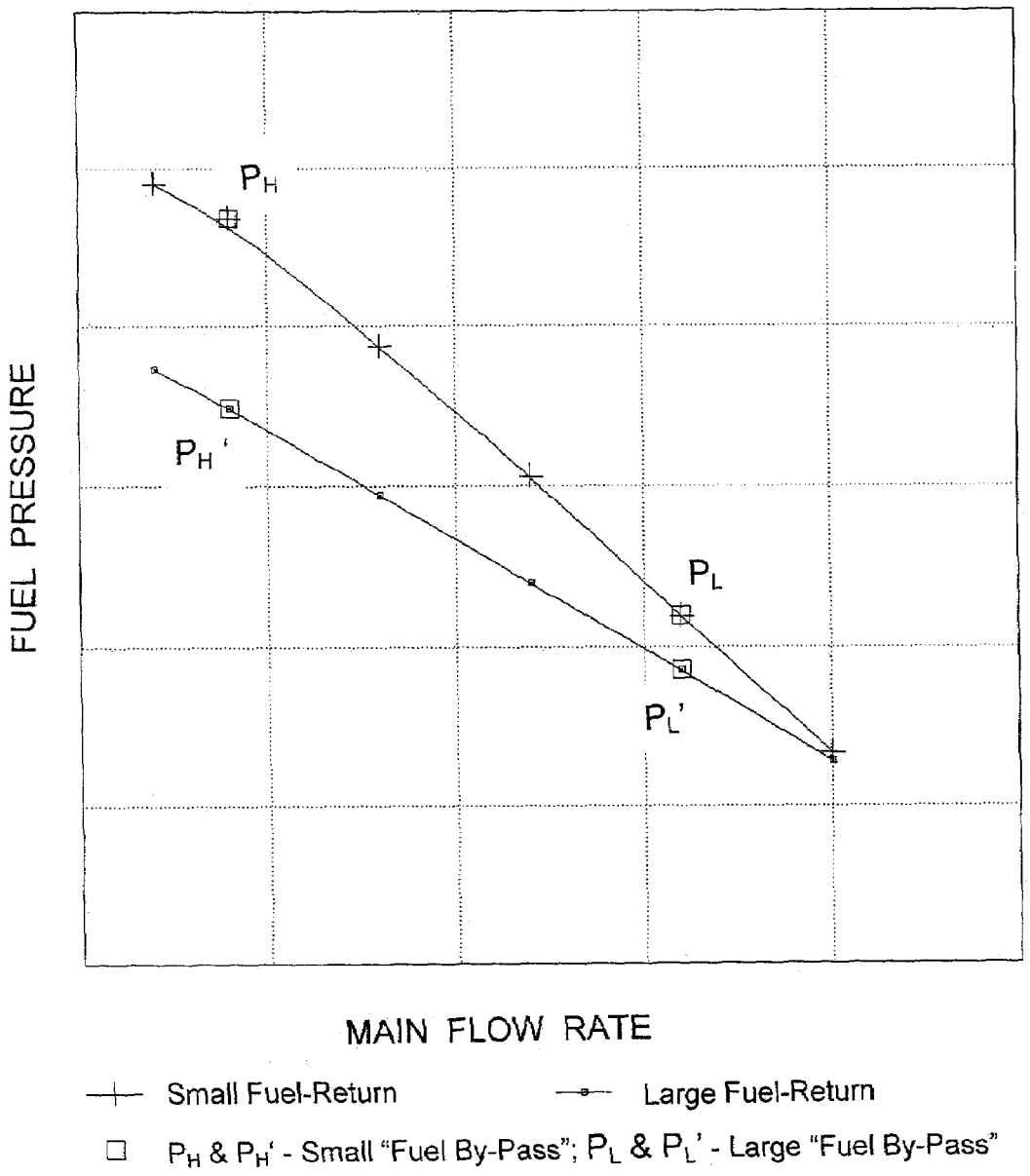
FIG. 3 is a representative relationship between fuel pressures versus the total fuel flow rate through a fuel pump at a constant speed in a fuel system like those shown in FIG. 1 and FIG. 2 according to the present invention.

A fluid system has certain similarities to an electrical circuit, where the fuel pump is equivalent to a power source and the fuel flow rate is equivalent to current in an electrical circuit. The fluid supply system as a whole provides a steady state impedance to the pump. When the fuel by-pass control is closed (normal operating condition), the fluid system is stabilized at a quiescent state at pressure $P_H$ for a given fluid flow rate $F_1$ (FIG. 3). When fuel-by-pass control 30 lets additional fuel $F_2$ flow through fuel by-pass lines 35, 37 to fuel tank, more fuel is fed through the fuel pump creating a new quiescent state at a lower pressure $P_L$ as shown in FIG. 3. Similarly, if the fuel by-pass control is normally open, closing the fuel-by-pass control will reduce the amount of fuel flowing through the pump. This will switch the pressure of the fuel system from the quiescent pressure state $P_L$ to a higher quiescent pressure state $P_H$. The switching over between the quiescent states is quick and the new pressure is achieved in just a few milliseconds which is the time for the pressure wave to travel from the control valve to fuel injectors at the acoustic velocity of fuel. Thus, it makes predictions to obtain the required amount of fuel per injected pulse a lot easier.

In this invention, the higher fuel pressure $P_H$ is set for start-up and normal operation, and the maximum pulse width (about 10 milliseconds) is set for the nominal maximum power (or slightly more). When the vehicle is operating in idle or driving at slow speed, the fuel-by-pass control is switched to open. This makes the fuel system operate at a lower pressure state $P_L$ while the fuel pump is running at the same speed as before. Because not much fuel is needed other than keeping the engine alive when the vehicle is idling, a manufacturer can set fuel injection pulse width at a minimum rate (about 2 milliseconds) and set a constraint on the fuel-by-pass line to obtain the lowest fuel pressure $P_L$ which accomplishes the fuel spraying properly and allows the engine still to run smoothly. The amount of fuel injected can be very small so that it barely keeps the engine running while still running the engine smoothly.

The action to open or close the fuel by-pass control can be done manually by flipping a control switch. It can also be controlled using an embedded controller where an electronic signal is sent to activate a control circuit which activates the actuator of the fuel by-pass control switch. Suitable programming logic is used by the controller, the steps of which are shown in the flow-charts of FIG. 5 and FIG. 6, and the operation of which is discussed subsequently in section D.

Figure 4:
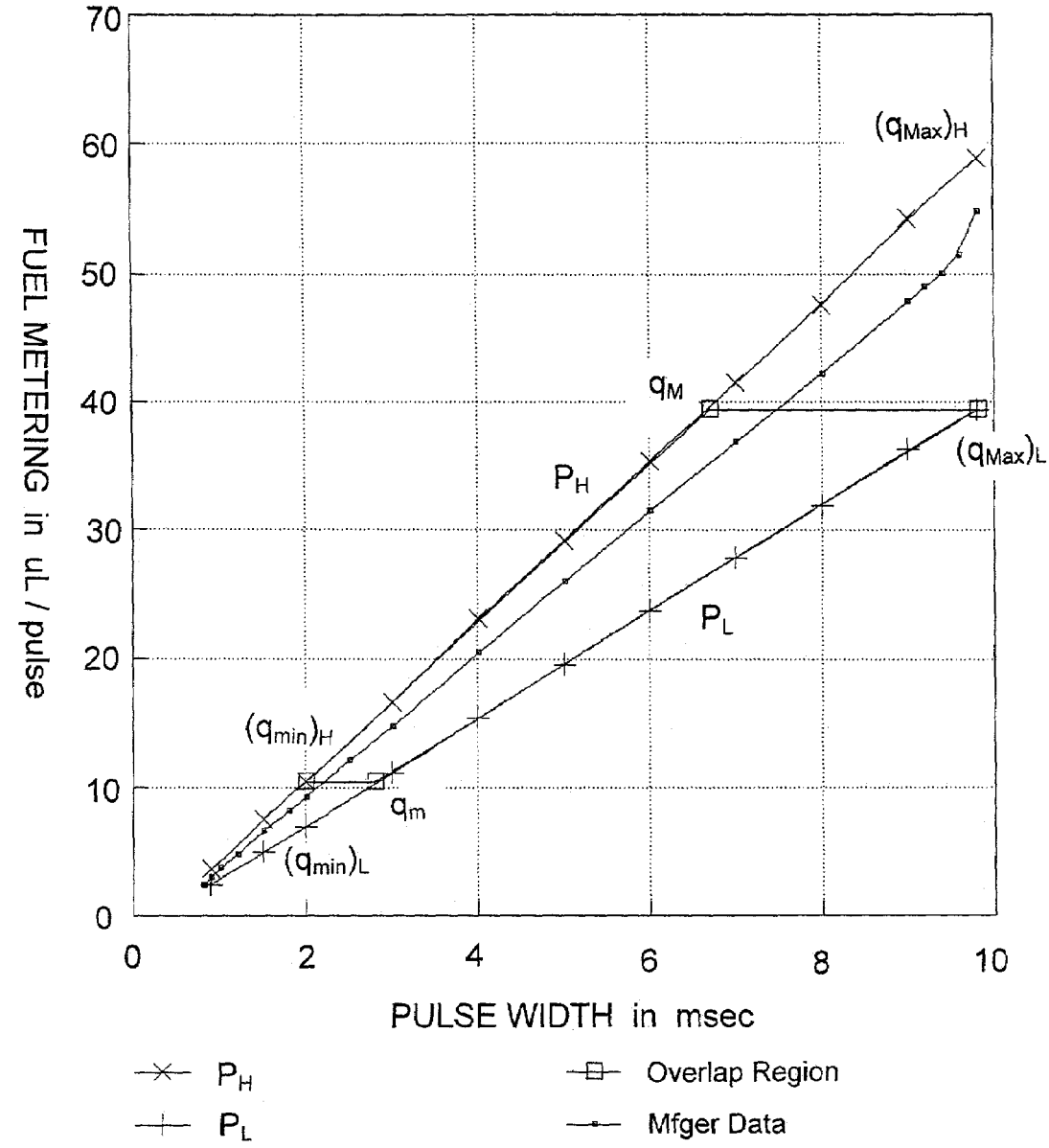
FIG. 4 is a typical fuel injection event between fuel injected per pulse and pulse width under different fuel pressures and constant pump speed.

Generally, under a given quiescent fuel pressure P, a fuel injector operating within its linear range (typical pulse width about 2- to 10-milliseconds) has a dynamic range as shown in FIG. 4 by the plotted points therein. Superposition of two linear operating ranges under two different fuel pressures will make the dynamic range wider (also shown in FIG. 4), where the smallest fuel injected per pulse $(q_{min})_H$ under higher pressure $P_H$ at minimum allowed pulse-width is equal to or less than the highest fuel injected per pulse $(q_{Max})_L$ under lower fuel pressure $P_L$ at maximum pulse-width, i.e. $(q_{min})_H<(q_{Max})_L$. As a result, the design team can assign the higher pressure $P_H$ for start-up, normal operation, and choose the pressure so that maximum nominal power is achieved at the longest allowed pulse width; the lower pressure $P_L$ for city driving and for idling can also be assigned. The pressure $P_L$ is tuned for idle so that the smallest fuel injected per pulse $(q_{min})_L$ under the shortest allowed pulse width makes the engine run at the slowest possible speed yet still run smoothly. Hence, it reduces fuel consumption when idle and increases the dynamic range of fuel injection. When the desired amount of fuel injected per pulse q is within the overlapping region, i.e., $$(q_{Max})_L>q>(q_{min})_H,$$

two values of pulse width exist for any given q. The design team chooses between higher pressure $P_H$ and lower pressure $P_L$ depending upon the expected driving condition and for a smooth transition without feeling roughness during the transition of pressure switching over. For those who are familiar with the state of the art of the technology, many alterations and combinations to the values for q, $P_H$, and $P_L$ can be selected for different applications. The voltage applied to the fuel pump can also be changed to create different sets of pressure P. The combination of the new fuel system design and the changes in applied voltage will provide enough flexibility for any vehicle to run smoothly from the fuel injection point of view.

FIG. 4 is a typical relationship between the amounts of fuel injected per pulse q versus pulse width in a dual pressure fuel injection system. In comparison with the actual fuel injection measurement by a fuel injector manufacturer for a 2.0-liter displacement engine, a dual pressure fuel injection system is capable of delivering more fuel injected per pulse at maximum pulse width $(q_{Max})_H$; the system is also capable of delivering less fuel per pulse at minimum pulse width $(q_{min})_L$ i.e., $$(q_{Max})_H>q_{Max},\ (q_{min})_L<q_{min};$$

and $$(q_{Max})_H/(q_{min})_L>q_{max}/q_{min}. \tag{5}$$

Using the dual pressure injection system can save fuel when compared to actual single pressure injection. For example, FIG. 4 shows a 25% fuel saving per pulse in a multi-point sequential injection when idle (compared to the actual data from an injector manufacturer). That means the same vehicle will consume about 40% less fuel per second at idle speed according to Eq. (2). It also means that the vehicle will generate 40% less auto emission which improves city-driving mileage. Although fuel saving and exhaust reduction may not seem much to a single vehicle, the cumulative effect on a congested highway or during a traffic jam in a city street where hundreds to thousands of vehicles are crawling, the affect will be noticeable. It would provide a lot of comfort to drivers, to people walking on the street, and to residents living nearby.

B. Fuel-Return Line for Fuel Pump Stabilization, Temperature Stability in Fuel Tank, and Delivering an Instant Excess Power On-Demand Using the same principle as described in the previous section, we can further improve the fuel injection fluid system by adding an extra fuel-return as shown in FIG. 2. Fuel-return-line 31 is connected from the output of fuel pump 11 (or at the output of filter 13) through fuel-return-control 32 (which is normally "Open"), line 33 back to fuel tank 10 (or through line 34 to intake line 51 of the fuel pump). Line 33 may also be connected to line 37 to decrease the cost. Fuel-return-control 32 can be an electromechanical valve, which may be controlled manually or electronically by using a microprocessor or an embedded controller. The amount of fuel through fuel-return may be adjusted to obtain different high pressure $P_H$ as shown in FIG. 3 where two linear lines represent two different pressures. If the flow of the fuel-return is larger than the flow for fuel injection, the structure will regulate the pressure of the fuel system to be almost constant.

The structure minimizes the dependence for the fuel pump to provide the exact amount of fuel for fuel injection and eliminates the need to return the unused excess fuel from fuel rail 17 (hot fuel) to fuel tank 10 to avoid pressure built-up. The structure also reduces the critical dependence to a fuel regulator, which contains numerous high-precision mechanical parts. Hence, the small amount of the fuel through a fuel-return line 31, 33 can stabilize the pressure and make the operation of the fuel pump steady. This minimizes the pulsating pressure spikes during fuel metering. Since no more hot fuel is returned to the fuel tank, fuel temperature in the fuel tank will remain unchanged regardless of how long the vehicle is in operation.

The amount of flow restriction imposed by fuel-return line 33 determines the value of the first quiescent pressure $P_H$. Typically, the lower the amount of fuel flowing through the fuel-return line, the higher the quiescent pressure $P_H$ will be. FIG. 3 has two plotted lines representing two different pressures $P_H$ which are created by a different amount of fuel-return. In addition, should there be a desire for the operator to obtain excessive power in a hurry, the ECU can electro-mechanically cut off the flow through fuel-return-lines 31, 33 and fuel-by-pass-lines 35, 37 resulting in a quick increase in fuel pressure for a short duration which delivers additional maximum power on-demand instantly for quick acceleration. The electro-mechanical "Off/On" action may be directed by a microprocessor or be controlled manually. Details on how to incorporate signals from various sensors to control the fuel pressure states and to determine the amount of fuel injected will be discussed in Section D and shown in a flow chart in FIG. 6.

C. Fuel Injection System that Incorporates Both Inventive Features

FIG. 2 is a complete fuel injection supply system that incorporates both features of the invention using fuel-by-pass control 30 (normally closed) and fuel-return control 32 (normally open). With fuel-return-control 32 normally open, the fuel pump is stabilized and there is no need to return hot fuel to the fuel tank. With fuel by-pass control 30 normally closed, the fuel injection system is similar to today's existing fuel injection supply systems, except that it is optionally designed to operate at a higher pressure $P_H$ than normally available with the more limited dynamic range of current systems. The operation under normal setting is similar to that in today's vehicles. It will be used for start-up, normal driving, engine warm-up, etc. Yet, when the engine has warmed up and the vehicle is being used for city (urban) driving or is idling, the fuel-by-pass control 30 can be opened electronically, which switches the fuel pressure from a higher pressure $P_H$ to the lower pressure $P_L$. The vehicle will be operating in the fuel saving mode and will reduce auto emission. Because the new system has a wider fuel injection dynamic range, as mentioned above, $P_H$ can be set slightly higher so that the same engine can deliver a little more power, yet the same engine can still reduce fuel consumption when idling to improve city-driving mileage and achieve fuel emission reduction.

Should the operator or system designer have a strong desire for instant high power on-demand, the system is structured to respond by closing both fuel-by-pass control 30 and fuel-return control 32 for quick acceleration. Such an operation may exceed the rating of the engine. Hence, the system should preferably allow the operator, or be otherwise designed, to perform such an operation under emergency bases and only for short time periods.

D. Flow Chart of the Microprocessor Controlled Fuel Injection Supply System

In a fuel injection supply system as shown in FIG. 2, a microprocessor is preferably used for collecting the input information from various sensors and executing the operating sequences. The microprocessor may be a standalone unit, multiple embedded controller units to execute more extended features, or shared with the main CPU (ECU, or ECM unit) to execute the fuel injection subroutine. One set of the I/O ports from the microprocessor is designated to receive sensor signals in regard to engine temperature, engine speed, engine power and torque, fuel pressure, throttle position, air flow and pressure, etc. Another set of I/O ports are connected to storage devices, such as ROM, PROM, EPROM, hard diskette, floppy diskette, CD-ROM, etc. The storage media are used to store the chart of fuel injection requirements, engine operating parameters, and the embedded program for executing the fuel injection control processes. All processing and calculations are done in the RAM also attached to the third set of I/O ports of the microprocessor. The last set of I/O ports is designated as the control signal outputs. The output signals are used to trigger the actuation circuits for valve action control.

FIG. 5 is a microprocessor electronic signal flow chart for the fuel system as shown in FIG. 1 where the fuel by-pass control is normally closed. The microprocessor detects the needs of the engine and measures the pressure differences between air manifold (not shown) and fuel rail in step 101, determines the amount of fuel needed by the engine Q in step 103, calculates the required amount of fuel injected per pulse q in step 105, and determines the pulse width for the fuel injected per pulse q in step 120. In decision block 110, if the calculated q is less than the maximum amount of fuel injected per pulse under the low fuel pressure state $q<(q_{max})_L$ and the engine is warm, according to decision block 115, the microprocessor will send an electronic signal to activate the control circuit that actuates fuel-by-pass control valve to open (step 119). This switches the fuel system to a lower fuel pressure state $P_L$. On the other hand, if $q>(q_{max})_L$ 110 or the engine is cold, fuel-by-pass-control stays Closed. Fuel pressure will remain in the higher-pressure state $P_H$, as indicated by 117. In either pressure state, the microprocessor will detect the new fuel pressure and determine the pulse width for the fuel injected per pulse q (step 120) in the next fuel injection cycle.

An electronic pulse of the pulse width is sent to a control circuit (not shown in the FIG. 5) that actuates the fuel injector valves under the pre-determined pulse width. Sensor signals of the actual engine performance are collected and used to compare with the original data of the anticipated results. The microprocessor makes proper adjustment and determines the revised pulse width, then sends the next round of control signals.

FIG. 6 is an electronic signal flow chart for the fuel system as shown in FIG. 2 where the fuel by-pass control is normally closed and the fuel-return control is normally open. Fuel-return is installed to stabilize the fuel pump operation and to minimize the pressure fluctuation of the fuel system. The fuel-return control is normally open. Hence the flow chart for the control processes of fuel-by-pass is the same as those shown in FIG. 5. However, when the operator has a strong desire to demand maximum power instantly 150, 151, 152, the signal from the pedal position sensor is compared with the maximum electronic signal from gas pedal position sensor $V_{gas}=(V_{gas})_{Max}$ repeatedly for N times 153, where N is pre-set and maybe in the range of 30 to 100 to assure the validity of the urgent needs. If the engine is not over-heated 154, the microprocessor will send a flag 155 to over-ride any command to the fuel injection system, close the fuel-return control and fuel-by-pass control, over-ride the engine temperature sensor "Warm/Cold," and send a maximum pulse width signal to the fuel injectors. This is the only time the fuel-return is activated to close and extra fuel pressure is added to the system to deliver additional amount of fuel per pulse for extra maximum power. Simultaneously, the microprocessor will activate all throttle valves to open fully allowing in-take air to flow at its maximum.

The only overriding signal occurs when the engine is overheating. In that case, the fuel-return valve will remain Open and the fuel-by-pass valve is closed. The fuel system will stay at a higher-pressure state $P_H$. Because the engine may operate beyond its normal rating, the operation as described in FIG. 6 should only be operated for a short time, i.e. $t<t_{allowed}$. The design team can pre-set the allowed time $t_{allowed}$, which may be in the range of 10 to 60 seconds. When the operation exceeds the pre-set time $t>t_{allowed}$ 163, the controller will open fuel-return 164. All of process 165 will follow the flow chart as shown in FIG. 5.

E. Modification of Vehicles Already In-Use for Improved City-Driving-Mileage & Reduced Auto Exhaust Any vehicle already in use which uses a single pressure fuel injection system can be modified easily to include the present invention and thereby increase its city-driving mileage, save fuel, and reduce auto exhaust emission. The modification adds an electromechanical fuel-by-pass control 30 (normally closed) and fuel by-pass lines 35, 37 that connect from the output of fuel filter 13 (or output of fuel pump 11) to fuel tank 10 (or to the fuel in-take line 51 to fuel pump 11) as shown in FIG. 1. For vehicles that have a hot fuel return line from a fuel rail, the fuel by-pass line may be connected from the output of the fuel pump to the hot-fuel-return line for easier modification and cost saving.

Fuel by-pass control 30 is normally closed. The modification will not effect the normal operations of the existing vehicle. When the vehicle is being used for city driving or is sitting idle, the fuel by-pass control will be open. Fuel by-pass lines 35, 37 add extra fuel through the fuel pump resulting in a reduced steady pressure $P_L$. Hence, less amount of fuel will be injected per pulse for the same pulse width. This reduces engine idle speed, saves fuel, improves city-driving mileage, and reduces auto emission. The modification is simple and inexpensive. The benefits are especially significant in metropolitan areas where large numbers of vehicles are in operation.

The invention provides different fuel pressure levels under a constant fuel pump speed and has been described with reference to certain internal combustion engines. The invention, however, applies to any number of internal combustion engines or other engines making use of a fuel injection system. As such, the invention is applicable to diesel engines and aircraft engines that use fuel injection processes. One skilled in the art would have no difficulty applying the invention to other kinds of engines.

Additional advantages and variations will be apparent to those skilled in the art, and those variations, as well as others which skill or fancy may suggest, are intended to be within the scope of the present invention, along with equivalents thereto, the invention being defined by the claims attended hereto.

The invention claimed is:

1. A multi-pressure fuel injection system for use with an engine, comprising;

a fuel supply for the system;

a fuel pump connected to the fuel supply and adapted to be operated at a predetermined speed;

at least one fuel injector, a main fuel line, providing fluid connection from the outlet of the fuel pump to the at least one fuel injector;

a fuel by-pass line with flow constraint having one end connected to some location on the main fuel line including the outlet of the fuel pump avoiding fuel rail and fuel injector, and the other end connected to some location in the fuel supply, including the inlet of the fuel pump, to provide fuel flow back to the fuel supply when the system is operating; and a fuel by-pass control in the fuel by-pass line, capable of opening and closing almost instantaneously, changing the pressure of the system between two designed pressure states, including a higher pressure state and a lower pressure state thereby essentially instantaneously changing the pressure of the fluid in the main fuel line between the two pressure states and the rate of fuel delivery at the at least one fuel injector.

2. A multi-pressure fuel injection system for use with an engine, comprising:

a fuel supply for the system;

a fuel pump connected to the fuel supply and adapted to be operated at a predetermined substantially constant speed;

at least one fuel injector connecting to fuel rail, a main fuel line, providing fluid connection from the outlet of the fuel pump to the fuel rail and the at least one fuel injector;

a fuel-return path having one end communicating with the main fuel line including the outlet of the fuel pump and avoiding fuel rail and fuel injectors, and the other end communicating with the fuel supply to the fuel pump inlet, and means for controlling additional flow through the fuel-return path to create a fuel recirculating loop to divert sufficient amounts of fuel during most of the operating conditions of the engine to substantially stabilize the pressures on the fuel pump to render the fuel system substantially self-regulating and to minimize the need of a hot fuel return; and a fuel by-pass line with flow constraint having one end connected to some location on the main fuel line including the outlet of the fuel pump and avoiding fuel rail and the at least one fuel injector, and the other end connected to some location in the fuel supply, including the inlet of the fuel pump, to provide fuel flow back to the fuel supply when the system is operating; and a fuel by-pass control in the fuel by-pass line, capable of opening and closing almost instantaneously, changing the pressure of the system between the two designated pressure states, including a higher pressure state $P_H$ and a lower pressure state $P_L$ thereby essentially instantaneously changing the pressure of the fluid in the main fuel line between the two pressure states and the rate of fuel delivery at the at least one fuel injector.

3. The system of claim 2, further comprising a fuel pump which maintains substantially constant speed irrespective of which of the pressure states the system is in and the by-pass control being effective so that the change of pressure is effective immediately.

4. The system of claim 2, further comprising a computer programmed to actuate the fuel injector to deliver pulses of fuel, the computer receiving signals indicating operating conditions of the engine in order to select between the pressure states and varying the pulse width to control the sizes of the injected fuel pulses over a dynamic range at the selected pressure state, the dynamic range being widened by switching between the pressure states, the computer delivering the pulses under the high pressure state under some operating conditions and under the lower pressure state under other operating conditions.

5. The system of claim 4, wherein the operating conditions are sensed from signals, including but not limited to engine temperature, speed, torque, fuel pressure and air pressure, pedal position sensing, operators intention, end adjustments are made as needed by a computer.

6. The system of claim 4, wherein the computer includes programming to signal the fuel bypass control to open and create the low pressure state in response to signals from engine management control that the engine is sufficiently warm and the amount of fuel per pulse being demanded is less than the maximum pulse amount available under the low pressure state.

7. The system of claim 4, wherein the fuel by-pass is adapted for the two pressure states to have overlapping fuel pressure operating ranges, the two ranges creating the widened dynamic range while the fuel pump runs at a substantially constant speed.

8. The system of claim 2, further comprising means for constraining the fuel flow, wherein said means comprises one of the following: an orifice plate with a hole of predetermined diameter, a needle-valve-like device, or a device compressing the fuel by-pass end the fuel-return line to create various fuel-return-flow and fuel-by-pass flow constraint.

9. A fuel injection system comprising:

a fuel supply, at least one fuel injector, a fuel pump connected to the fuel supply and driven at a substantially constant speed;

a fuel supply line from the outlet of the fuel pump to the at least one fuel injector.

a fuel return path with flow constraint from the main fuel line, including the outlet of fuel pump and avoiding fuel rail, to fuel tank including the inlet of fuel pump;

at least one fuel by-pass line, avoiding fuel rail and fuel injectors, with flow constraint connected between some location in the main fuel supply line, including the outlet of the fuel pump to some location in the fuel supply, including the inlet of the fuel pump, and a fuel by-pass control including programming to separately open and close each fuel bypass line essentially, instantaneously, the opening or closing of each by-pass control instantaneously changing the pressure of the system between a higher pressure state and a lower pressure state.

10. The system of claim 9, wherein the computer controls the opening or closing of each fuel-return line to create multiple pressure states at preset pressure levels.

11. The system of claim 9, wherein all fuel by-pass lines for fuel-return and fuel by-pass include a flow-constraint structure.

12. The system of claim 9, wherein the fuel by-pass control comprises an electromechanical valve and means for actuating the valve in response to fuel demand.

13. The system of claim 9, wherein a computer is provided to actuate fuel by-pass controls and includes programming to open and close the selected by-pass lines in response to varying fuel demands.

14. The system of claim 13, wherein there is a normally closed fuel by-pass line and the fuel by pass control includes programming to open the control in that normally closed fuel by-pass line during idling to create a lower pressure state, and the computer selects a corresponding minimum fuel pulse according to the lower pressure state to conserve fuel when gas pedal is released and during the idling.

15. The fuel injection system of claim 9 in which a computer is used for selectively opening or closing by-pass's controls in one or more selected bypass fuel lines in response to operating conditions of the engine to instantly create different selected fuel pressure states in the system for fuel demand.

16. The system of claim 9, wherein the fuel pump has another predetermined speed to further enhance fuel injection dynamic range.

17. A multi-pressure fuel injection system for use with an engine, comprising, a fuel supply for storing fuel for the system, a fuel pump adapted to be operated at predetermined speed, at least one fuel injector, a main fuel line providing fluid connection from the outlet of the fuel pump and to the at least one fuel injector, at least two fuel by-pass lines with flow constraint having one end connected to some location on the main fuel line avoiding the fuel rail and fuel injectors, and the other end connected to some location in the fuel supply, including the inlet or the fuel pump, a fuel by-pass control in each fuel by-pass line capable of opening and closing its line almost instantaneously, thereby essentially instantaneously changing the pressure of the fluid in the main fuel line between two pressure states and the rate of fuel delivery at the at least one fuel injector, a computer to open and close selectively each fuel by-pass control.

18. The system of claim 17, wherein the computer includes programming to open and close selected by-pass lines selectively to create at least three pressure levels.

19. The system of claim 17, comprising two fuel by-pass lines, one a normally closed fuel by-pass and the other normally open fuel-return line.

20. The system of claim 19, wherein the fuel-return line is normally open to allow fuel recirculation in the fuel system to stabilize pump operation and minimize the need of a hot fuel return.

21. The system of claim 20, wherein the computer includes programming to process signals corresponding to power demands of the user and to dose both fuel return lines to create additional, available maximum engine power.

22. The fuel injection system of claim 17 in which the computer receives control signals based on the amount of fuel being demanded in response to engine operating conditions, including operators input and the engine temperature, to generate signals to open or close the fuel by-pass control in each fuel by-pass line to allow selected pressure at the at least one fuel injector, and to adjust the fuel injection pulse width according to engine fuel demand.

23. The fuel injection system of claim 17 in which the computer also adjusts the injection pulse width of a plurality of fuel injectors used in a particular system.

24. A fuel injection system for delivering fuel from a fuel supply to fuel injectors of an engine, the system comprising:

a fuel supply;

a fuel pump driven at a substantially constant speed;

at least one fuel injector;

at least one fuel by-pass line avoiding fuel rail and fuel injectors, connecting the outlet of the fuel pump and the fuel supply;

a fuel by-pass control in each fuel by-pass line for opening and closing substantially instantaneously in a selected by-pass line in response to operating conditions of the engine to create different fuel pressures in the system, a computer for determining the amount of fuel required per pulse for fuel injection, for determining whether the required amount of fuel is within the limit of one or more of the fuel pressures producible in the system, and for selecting the appropriate one of the fuel pressures in response to (a) operating condition of the engine, (b) the demand for engine power, or (c) manual control by the operator.

25. The system of claim 24, wherein the computer actuates the by-pass control in selected fuel by-pass lines during cold engine operations to create a first, higher pressure state, the computer receiving signals from engine management control that the engine is warm and the demanded fuel pulse is less than the maximum fuel pulse which the lower pressure slate can supply, opening the fuel by-pass path to create the lowest pressure state which is, higher than the minimum pressure needed to assure proper fuel spraying.

26. A method of improving city-driving fuel efficiency in a fuel injection engine comprising, pumping fuel from a fuel tank to a fuel rail and at least one fuel injector for the engine at a predetermined substantially constant speed, by-passing some fuel from main fuel line, including the outlet of the fuel pump, avoiding the fuel rail and fuel injector, back to the fuel tank by a normally closed connection with flow constraint, opening on-demand the normally closed connection to instantaneously vary the fluid pressure of the fuel from higher pressure state $P_H$ to the lower pressure state $P_L$ thereby instantaneously reducing fuel pressure and the amount of injected fuel at the at least one fuel injector every time the gas pedal is released for fuel saving in city driving.

27. The method of claim 26 in which the two pressure states include one $P_L$ near the lowest minimum pressure at which fuel can be effectively injected for fine fuel spraying and one $P_H$ near the nearest state to that desired to produce maximum power.

28. The method of claim 27 in which further control of fuel feed at each state can be accomplished by varying the pulse width of injection pulses at each injection nozzle to vary me amount of fuel injected at each pulse, wherein the minimum allowed pulse width at low pressure state is used when the gas pedal is released and for idling to save fuel in city driving, and the maximum pulse width at high pressure state is used to produce maximum power rated for me engine.

29. A method of providing exceptional high-performance and improving city driving fuel efficiency in a fuel injection engine comprising, pumping fuel from a fuel tank to at least one fuel injector for the engine at a substantially constant predetermined speed, by-passing some fuel from the fuel pump outlet back to the fuel tank by a normally closed connection with flow constraint avoiding the fuel injector, returning same fuel from the fuel pump outlet back to the fuel tank by another normally open connection with flow constraint avoiding the fuel rail and the fuel injector to form a fuel circulating loop stabilizing the fuel pump operation and minimizing the need of hot fuel return line, and opening and closing both or one of the connections with essentially no time lag to instantaneously vary the fluid pressure of the fuel among at least three pressure states and thereby instantaneously varying the amount of injected fuel pulses for a given pulse width at the at least one fuel injector for each pressure state.

30. The method of claim 29 in which the at least two lower pressure states among the three pressure states include one near the lowest minimum pressure required for fine fuel spraying and one near the nearest state to that desired to produce maximum power.

31. The method of claim 29 in which further control of fuel feed at each state can be accomplished by varying the injection pulse width at each injection nozzle the amount of fuel injected at each pulse, where the minimum allowed pulse width at low pressure state is used for city driving when gas pedal is released and for idling and the maximum pulse width at high pressure state is used to produce maximum power rated for the engine.

32. The method of claim 29 in which after repeated verifications of operator's urgent needs for maximum power the $V_{gas}=(V_{gas})_{max}$ for N times to avoid faulty electronic signal and the engine is not overheating, activating signals to close both fuel-return and fuel by-pass lines creating the 3rd high pressure state, opening the throttle valve and other air accessories for maximum air in-take, and delivering maximum fuel injection for extraordinary power exceeding the maximum rating of the engine for a short duration.

33. A method of modifying existing vehicles with fuel injection engines to achieve better fuel efficiency in city-driving comprising, connecting at least one normally closed fuel by-pass line with flow constraint and a controller from the main fuel line avoiding fuel rail back to the fuel supply or the intake side of the fuel pump, and opening the normally closed fuel by-pass line with fuel constraint on demand when the engine is warm to reduce the fuel pressure, thus saving fuel every time when gas pedal is released and during idling to achieve fuel efficiency in city-driving.

34. The method of claim 33, creating and storing in a controller memory a separate set of fuel injected per pulse versus pulse width values for the new low pressure state as the look up chart so that engine management controller can deliver proper amount of fuel when engine is operating at the new low pressure state to reduce idling speed and every time when gas pedal is released, thus achieving fuel efficiency in city-driving.

35. A fuel injection system comprising:

a fuel supply, at least one fuel injector, a fuel pump connected to the fuel supply and driven at a substantially constant speed, a main fuel line from the outlet of the fuel pump to the at least one fuel injector, at least two fuel bypass lines with flow constraint connected from some location in the main fuel line including the fuel pump outlet avoiding fuel rail and fuel injectors, to some location in the fuel supply, including the fuel pump inlet, and a fuel by-pass control in at least one fuel bypass line which can selectively open and close the by-pass line to instantaneously change system fuel pressure states.

36. A fuel injection system providing exceptional high performance and still achieving fuel saving in city driving comprising:

a fuel supply, at least one fuel injector, a fuel pump having an outlet and an inlet connected to the fuel supply and driven at a substantially constant speed, a main fuel line from the outlet of the fuel pump to the at least one fuel injector, two fuel bypass lines with flow constraint connected from the main fuel line, including the fuel pump outlet but excluding fuel injector, to the fuel supply including the inlet of the fuel pump, or both, and a fuel by-pass control in each fuel bypass line which can be opened or closed essentially instantaneously, the control in one bypass line being normally open so that its line normally allows fuel recirculation in the system to stabilize the fuel pump operation and to minimize the need of hot fuel return line, and the fuel by-pass control in the other fuel bypass line being normally closed so that its line can be opened to reduce fuel pressure as needed for fuel saving in city driving.

37. The fuel injection system of claim 36 in which a computer is provided to determine when conditions are right for either of the two conditions:

(a) of one normally closed controller being open for fuel saving in city driving, or (b) both controls being closed to provide for greater acceleration for limited periods when the engine temperature will permit it and other conditions are appropriate, at which time, upon operation demand, both fuel line controls are closed to greatly increase the pressure above the higher of the two pressure states.

38. A fuel injection system for delivering pressurized fuel from a fuel supply to fuel injectors of an engine which uses a fuel recirculation loop to minimize or eliminate the need of a hot fuel return line and a low pressure regulator comprising:

a fuel supply, a fuel rail in fluid communication with at least one fuel injector, a fuel pump having an outlet and an inlet, the inlet being connected to the fuel supply and driven at a substantially constant speed, a main fuel supply line connected from the outlet of the fuel pump to the fuel rail in fluid communication with the at least one fuel injector, a fuel return path with flow constraint, connected from some location in the main fuel supply line, including the outlet of the fuel pump, avoiding fuel rail to some location in the fuel supply including the inlet of the fuel pump, allowing fuel recirculation to stabilize the pump operation, and creating stable fuel pressure.

39. The fuel injection system of claim 38 comprising at least one additional fuel by-pass line connected between some location in the main fuel supply line, including the outlet of the fuel pump avoiding fuel rail to some location in the fuel supply, including the inlet of the fuel pump, and a fuel by-pass control to open and close each additional fuel by-pass line, the opening or closing of each fuel by-pass control instantaneously changing the pressure of the system between a higher pressure state and a lower pressure state.

40. A fuel injection system for delivering fuel from a fuel supply to fuel injectors of an engine which uses a fuel recirculation loop to minimize the need of a hot fuel return line and a low pressure regulator, comprising:

a fuel supply, a fuel rail in fluid communication with at least one fuel injector, a fuel pump having an outlet and an inlet, the inlet being connected to the fuel supply and driven at a substantially constant speed, a main fuel supply line connected from the outlet of the fuel pump to the fuel rail in fluid communication with at least one fuel injector, a fuel return path with flow constraint, provided by an orifice of predetermined diameter in the return path connected from some location in the main fuel supply line, including the outlet of the fuel pump avoiding fuel rail, to some location in the fuel supply including the inlet of the fuel pump, allowing fuel recirculation to stabilize the pump operation creating stable fuel pressure.

41. A fuel injection system for delivering fuel from a fuel supply to fuel injectors of an engine, which uses a fuel recirculation loop to minimize the need of a hot fuel return line and a low pressure regulator, comprising:

a fuel supply, a fuel rail in fluid communication with at least one fuel injector, a fuel pump having an outlet and an inlet, the inlet being connected to the fuel supply and driven at a predetermined substantially constant speed, a main fuel supply line connected from the outlet of the fuel pump to the fuel rail in fluid communication with the at least one fuel injector, a fuel return path with flow constraint provided by a needle valve in the return path, connected from some location in the main fuel supply line, including the outlet of the fuel pump, avoiding the fuel rail, to some location in the fuel supply including the inlet of the fuel pump, avoiding fuel recirculation to stabilize the pump operation creating stable fuel pressure.

42. A fuel injection system for delivering pressurized fuel from a fuel supply to fuel injectors of an engine which uses a fuel recirculation loop to minimize the need of a hot fuel return line and a low pressure regulator, comprising:

a fuel supply, a fuel rail in fluid communication with at least one fuel injector, a fuel pump having an outlet and an inlet, the inlet being connected to the fuel supply and driven at a substantially constant speed, a main fuel supply line connected from the outlet of the fuel pump to the fuel rail in fluid communication with at least one fuel injector, a fuel return path with flow constraint, provided by a device compressing the fuel by-pass or the fuel-return path, connected from some location in the main fuel supply line, including the outlet of the fuel pump avoiding fuel rail, to some location in the fuel supply including the inlet of the fuel pump, allowing fuel recirculation to stabilize the pump operation creating stable fuel pressure.

43. A method of obtaining highest pressure instantaneously to deliver maximum fuel injection pulses for start-up of cold direct injection engine and for short burst of power for acceleration, comprising:

closing all fuel by-pass lines, and closing all fuel return lines including closing all excess fuel return lines from pressure regulators if there is any.

44. A kit providing fuel saving and auto exhaust reduction in city driving for vehicles with a fuel injection system for internal combustion engines currently in production or earlier models of vehicles already in use, comprising, a by-pass fuel line with flow constraint including a normally closed electromagnetic valve, for connecting from the main fuel line back to fuel tank to provide a fuel pump by-pass path without changing normal fuel delivering flow, hardware connection, such as a T, allowing connection of the by-pass fuel line into main fuel line, including the outlet of fuel pump, avoiding fuel rail and fuel injector, hardware connection permitting the other end of the fuel by-pass line to be connected into a fuel return line, or directly into the fuel tank in a manner to prevent leakage of fuel vapor to the air, and means for opening the normally closed electromagnetic valve in the by-pass line when engine is warm and the vehicle is in the city driving mode to instantaneously reduce the fuel pressure to a predetermined level to save fuel every time the gas pedal is released including during idling.

45. The kit of claim 44 which include a conveniently positionable manually actuated switch in the control circuit of the electromagnetic valve that allows the operator in observing the engine temperature gauge to instantaneously open the normally closed fuel valve in the fuel by-pass line to choose the lower pressure state $P_L$ for fuel saving in city driving.

46. The kit of claim 44 which includes programs to be installed in memory supplementing the existing E.C.U. and Engine Management Control for operating the electromagnetic valve in the fuel by-pass line, comprising:

additional look-up chart of fuel pulse versus pulse width curves under the lower pressure state $P_L$ and under the higher pressure state $P_H$, end operating software program including the selection of a proper pressure state from the lower pressure state $P_L$ for city driving, or the higher pressure state $P_H$ for highway driving.

* * * * *

UNITED STATES PATENT AND TRADEMARK OFFICE

CERTIFICATE OF CORRECTION

PATENT NO. : 7,318,414 B2
APPLICATION NO. : 10/143657
DATED : January 15, 2008
INVENTOR(S) : Shou Hou It is certified that error appears in the above-identified patent and that said Letters Patent is hereby corrected as shown below:

Claim 5, line 62, col. 12 “intention, end” should read -- intention, and --;

Claim 8, line 13, col. 13 “by-pass end” should read -- by-pass and --;

Claim 17, line 11, col. 14 “inlet or” should read -- inlet of --;

Claim 21, line 32, col. 14 “to dose both” should read -- to close both --;

Claim 25, line 5, col. 15 “pressure slate” should read -- pressure state --;

Claim 28, line 31, col. 15 “vary me” should read -- vary the --;

Claim 28, line 35, col. 15 “rated for me” should read -- rated for the --;

Claim 29, line 46, col. 15 “returning same” should read -- returning some --;

Claim 41, line 18, col. 18 “pump, avoiding” should read -- pump, allowing --;

Claim 46, line 5, col. 20 “$P_H$, end” should read -- $P_H$, and --;

Signed and Sealed this

Twentieth Day of May, 2008

JON W. DUDAS
*Director of the United States Patent and Trademark Office*

(12) INTER PARTES REVIEW CERTIFICATE (521st)

United States Patent
Hou

(10) Number: US 7,318,414 K1
(45) Certificate Issued: Feb. 9, 2018

(54) CONSTANT-SPEED MULTI-PRESSURE FUEL INJECTION SYSTEM FOR IMPROVED DYNAMIC RANGE IN INTERNAL COMBUSTION ENGINE

(75) Inventor: Shou L. Hou

(73) Assignee: TMC FUEL INJECTIONS SYSTEMS, LLC

Trial Numbers:

IPR2014-00272 filed Dec. 19, 2013
IPR2014-00273 filed Dec. 19, 2013

Inter Partes Review Certificate for:

Patent No.: 7,318,414
Issued: Jan. 15, 2008
Appl. No.: 10/143,657
Filed: May 10, 2002

The results of consolidated IPR2014-00272 and IPR2014-00273 are reflected in this inter partes review certificate under 35 U.S.C. 318(b).

INTER PARTES REVIEW CERTIFICATE
U.S. Patent 7,318,414 K1
Trial No. IPR2014-00272
Certificate Issued Feb. 9, 2018

AS A RESULT OF THE INTER PARTES REVIEW PROCEEDING, IT HAS BEEN DETERMINED THAT:

Claims 38 and 40 are found patentable.

* * * * *